United States Patent [19]

Rutter et al.

[11] Patent Number: 4,948,014

[45] Date of Patent: Aug. 14, 1990

[54] TWO PIECE VALVED FLUID DISPENSER

[75] Inventors: Christopher C. Rutter, Oakland; Lee H. Laiterman, Los Gatos, both of Calif.

[73] Assignee: Rapak, Inc., Hayward, Calif.

[21] Appl. No.: 263,007

[22] Filed: Oct. 26, 1988

[51] Int. Cl.[5] ..... B65D 35/00

[52] U.S. Cl. ..... 222/83; 222/105; 222/506; 137/614.04; 251/149.6; 285/316

[58] Field of Search ..... 222/505, 506, 509, 545, 222/549, 553, 105, 33; 251/149.6, 339, 342, 365; 137/614.03, 614.04; 285/316

[56] References Cited

U.S. PATENT DOCUMENTS

| | | | |
|---|---|---|---|
| 3,081,911 | 3/1963 | Scholle | 222/105 X |
| 3,170,667 | 2/1965 | Szohatzky | 251/149.6 |
| 3,684,321 | 8/1972 | Hundhausen et al. | 285/316 |
| 4,026,581 | 5/1977 | Pasbrig | 285/316 X |
| 4,214,675 | 7/1980 | Schmit | 222/105 X |
| 4,375,864 | 3/1983 | Savage | 222/105 X |
| 4,475,670 | 10/1984 | Rutter | 222/519 X |
| 4,619,377 | 10/1986 | Roos | 222/549 X |
| 4,700,744 | 10/1987 | Rutter et al. | 222/553 X |

OTHER PUBLICATIONS

Christine, Combined Piercer and Valve for Flexible Bag, 9-1981, WO81/02418.

*Primary Examiner*—Kevin P. Shaver
*Assistant Examiner*—Boris Milef
*Attorney, Agent, or Firm*—Majestic, Parsons, Siebert & Hsue

[57] ABSTRACT

A dispenser includes a spout attached to a fluid-filled bag and a socket that is removable attached to the spout. Valves in each of the spout and socket are biased closed but are opened when the socket is latched onto the spout, thereby providing a fluid path from within the bag to the outside. Keying components are provided on each of the spout and socket in order that a fluid connection between them is made only when the key elements match. The valve within the spout extends into the bag when opened and may include a sharp bag wall piercing portion.

5 Claims, 4 Drawing Sheets

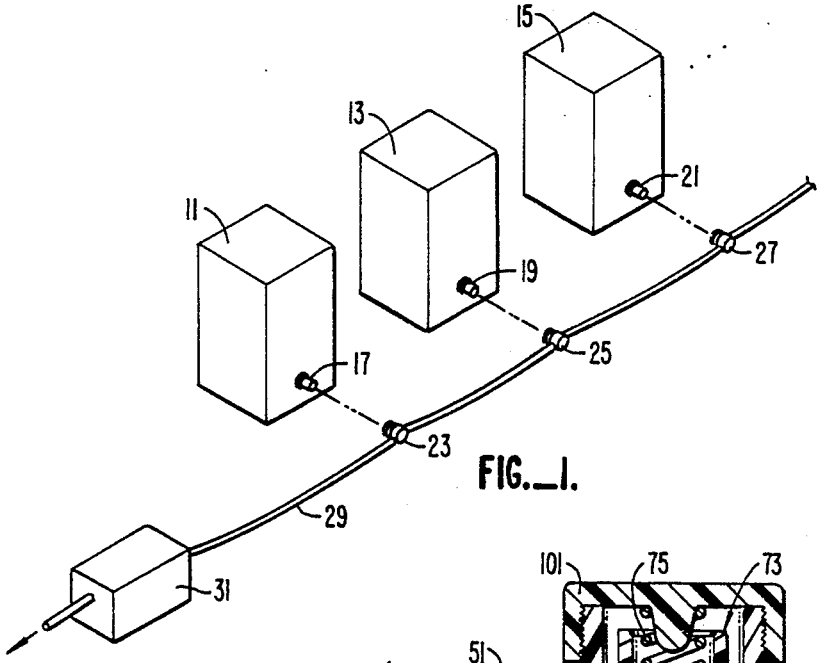
FIG._1.
FIG._2.
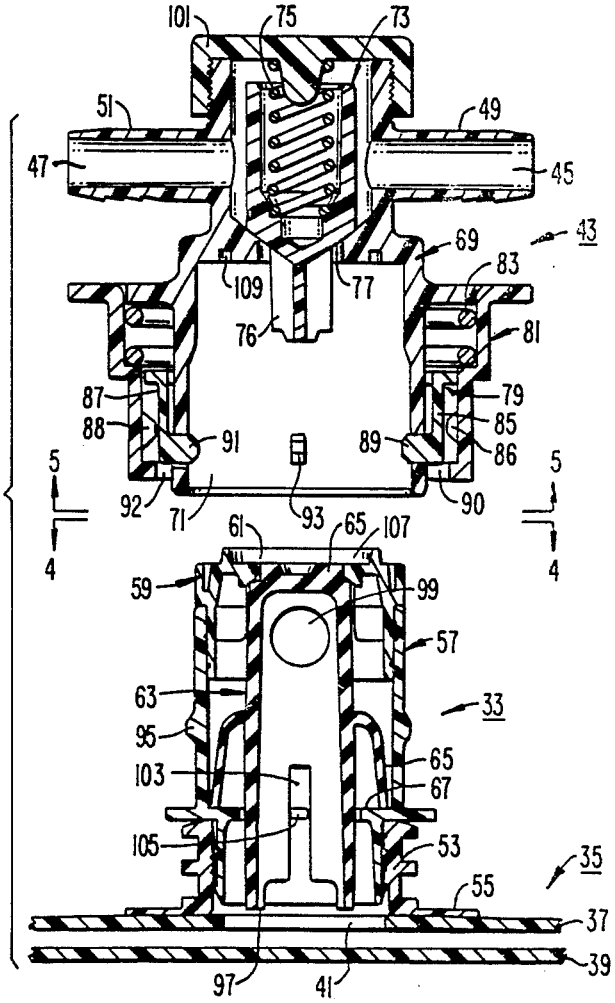

TWO PIECE VALVED FLUID DISPENSER

BACKGROUND OF THE INVENTION

This invention relates generally to fluid dispensers, and, more specifically, to improvements in fluid dispensers of the type used with bulk fluid containers such as bag-in-box containers.

Bag-in-box containers are becoming widely used for storage and shipment of various fluids, particularly food liquids, such as wine and milk, and industrial liquids, such as detergents and various chemicals. Such liquids are normally packed and sealed in a plastic bag. For some liquids, such as food items, it is important that air and other gases be excluded. The filled bag is placed within a strong outer container such as a corrugated box. This structure facilitates storage, shipment and use. A dispensing spout is attached to the filled bag near its bottom and extends outward through the container for access by the user.

Such dispensers come in many different types. Some are made to surround a prepunched opening in the bag, while others are used with a completely sealed plastic bag and an opening is punched through a bag wall by the user when the dispenser is first operated. All such dispensers include a valve that is biased closed. Some dispensers are adapted for the valve to be opened by hand manipulation to transmit fluid from the bag container, and others are adapted to receive a socket that, when fitted onto the bag spout, opens its valve and allows fluid to pass into a hose for transmission to a point of use removed from the container. An example of the last-mentioned type of dispenser is given in U.S. Pat. No. 4,700,744 to Rutter et al. (1987).

It is a primary object of the present invention to provide improvements in the last-mentioned type of dispenser.

SUMMARY OF THE INVENTION

This and additional objects are accomplished by the various aspects of the present invention which are embodied in the two-piece dispenser including a bag spout and a connectable socket, each piece having a resiliently loaded valve that opens when connected together. According to a specific aspect of the invention, a key system is provided on the mating spout and socket, different "keys" being provided to indicate different liquids in various containers. This feature is particularly useful in industrial liquid applications where it is important to assure that the correct material is in a container that is connected to a socket which is supplying liquid to a process. According to another specific aspect of the present invention, the valve member in the bag spout is provided with bag piercing apparatus at an end opposite to an end which mates with a valve seat to normally close off the spout. This feature allows the fluid container bag to remain completely sealed until a socket is first positioned on the bag spout, at which time the valve is urged against the bag to punch an opening in it.

Other specific aspects of the present invention, as well as advantages and features thereof, will become apparent from the following description of its preferred embodiments, which description should be taken in conjunction with the accompanying drawings.

BRIEF DESCRIPTION OF THE DRAWINGS

FIG. 1 illustrates a typical use for the improved bag spout and socket structure according to the present invention;

FIG. 2 shows in cross-section one embodiment of such a bag spout and socket before being connected together;

DESCRIPTION OF THE PREFERRED EMBODIMENTS

Figure 3:
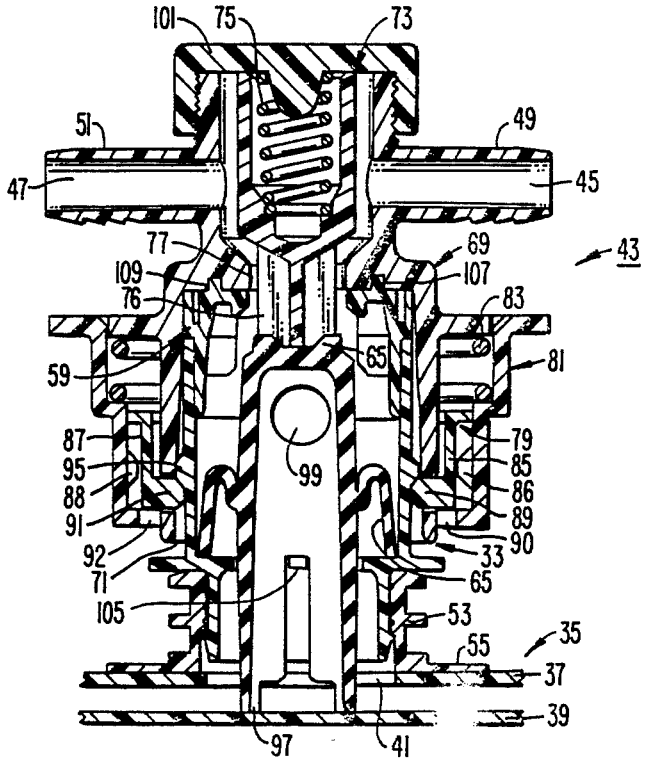
FIG. 3 shows a cross-sectional view of the bag spout and socket of FIG. 2 after they have been connected together.
Figure 4:
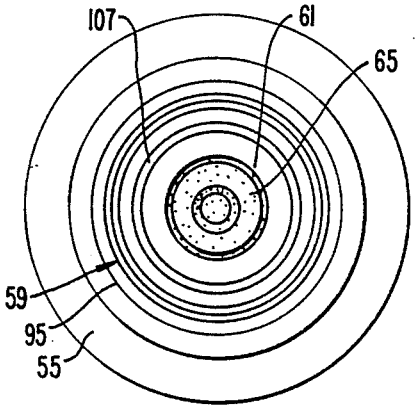
FIG. 4 is a view of an end of the bag spout of FIGS. 2 and 3, as viewed from position 4—4 of FIG. 2.
Figure 5:
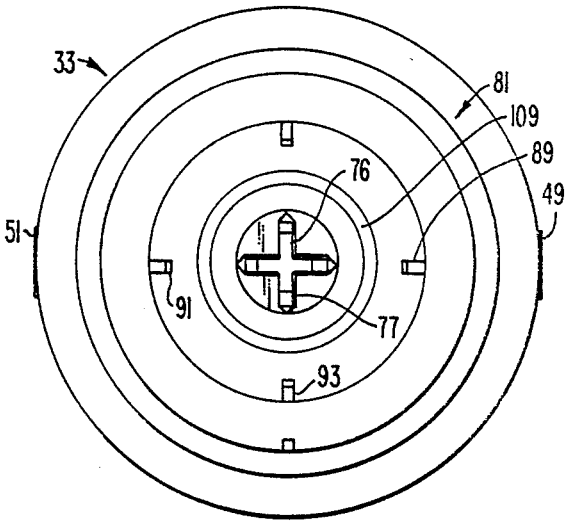
FIG. 5 is an end view of the socket of FIGS. 2 and 3, as viewed from position 5—5 of FIG. 2.

Referring initially to FIG. 1, one of many applications of the improved dispenser of the present invention is described. A plurality of corrugated boxes 11, 13 and 15 contain a liquid filled plastic bag within them. To each of these bags is attached a respective dispenser spout 17, 19 and 21. Each of these spouts extends through their respective containers. Each of the spouts is closed to fluid flow through them.

In order to obtain fluid from these containers, a plurality of sockets 23, 25 and 27 are connected in tandem along a fluid conduit 29. Each of these sockets is adapted to be connected to any of the bag spouts. A plurality of such sockets are used so that more than one container may be connected to the conduit 29 at once. This allows removal of an empty container and reconnection of a full container without interruption of fluid flow in the conduit 29. In such an example, the fluid in each of the containers 11, 13 and 15 will be the same. The fluid flow in the conduit 29 may proceed under the influence of gravity, or alternatively, a pump unit 31 may be utilized to deliver the fluid to its desired point of utilization. This approach is used in industrial applications where the fluid may be a detergent or cleaning solvent in some type of washing process, or may be chemicals provided as part of an industrial process, or the like.

Referring to FIGS. 2 and 3, a first embodiment of the present invention is described. A spout 33 is attached to a bag 35. The bag 35 includes two walls 37 and 39 that contain fluid between them. An opening 41 in the wall 37 is surrounded by spout 33. A socket 43 is provided to be manually connectable with the spout 33 and removed therefrom. When the socket 43 is so attached, fluid travels from the interior of the bag 35, through the spout 33 and socket 43, and out of openings 45 and 47 in respective tubular extensions 49 and 51. It is these tubular extensions to which the conduit 29 of the FIG. 1 system is connected. If only one such conduit or hose is to be connected to one of the tubular extensions 49 or 51, the other is simply sealed off.

The bag spout 33 includes a base 53 having a circular flange 55 that is attachable to the bag wall 37 by an appropriate adhesive, or by thermal bonding. A generally cylindrically shaped hollow body portion 57 is force-fit at one end thereof into the base 53 and rigidly held thereby. At another end thereof is force-fit an end member 59. The end member 59 includes an opening 61 in its middle, the edges of this opening forming a valve seat. In the interior of the body portion 57 is an elongated, generally hollow, cylindrically shaped valve member 63. One end 65 of the member 63 acts as a valve by closing off the opening 61 in the end member 69 when in its rest position as shown in FIG. 2. The valve member 63 is normally held in that rest position by a resilient member that is preferably formed as a skirt 65 surrounding the member 63 and terminating in an edge which rests on a ledge surface 67 of the body member 57.

The socket 43 has a connector body 69 with an interior cylindrically shaped opening 71 sized to fit over the outside of the spout 33. Within the body member 69 is a socket valve 73 that is resiliently urged by a coil spring 75 against a valve seat in the body 69 that surrounds an opening 77. The valve member 73 includes an "x" shaped protrusion 76 as a unitary portion of it. The purpose of the protrusion 76 is to contact the end 65 of the valve member 63 when the spout and socket are connected together in a manner shown in FIG. 3.

In order to allow removable attachment of the spout 33 and socket 43, a latching member 79 is captured within a ring member 81 that is positioned by a spring 83 in compression between the ring 81 and the body 69. The latching member 79 includes a plurality, in this case four, fingers, two of which are shown in FIGS. 2 and 3 at 85 and 87. Each of these fingers has a respective inwardly extending protrusion 89 and 91, each extending through an opening provided in the body 69. A third such protrusion 93 is also shown in FIG. 2.

Each of the fingers 85, 87, etc. is normally restrained to remain with their respective protrusions 89, 91, etc. extending inward of the body 81, the position shown in FIGS. 2 and 3. This restraint is provided by respective abutments 86, 88, etc. that are part of the socket body 81 and extend inward of it. Each of the abutments 86, 88, etc. is positioned behind one of the fingers 85, 87, etc.

When it is desired to allow the fingers 85, 87, etc. to flex upon connecting or disconnecting the spout 33 and socket 43, the ring 81 is moved in a direction compressing the spring 83. The ring 81 is provided with respective openings 90, 92, etc., one aligned with each of the fingers 85, 87, etc., in order to allow such movement. When the ring 81 is moved into such a position (not shown), the abutments 86, 88, etc. are located near the attachment point of the respective fingers 85, 87, etc., thus allowing the fingers to flex.

A cooperating latching element on the spout 33 is an annular ring 95 that protrudes outward of the outside wall of the body 57. When the socket 43 is moved over the spout 33 after the ring 81 has been moved, the fingers 85, 87, etc. of the latching member 79 are moved outward against their resiliency as their protrusions 89, 91, 93, etc. ride over the ring 95. When the spout 33 and socket 43 are fully seated, the ring 81 is released and these finger protrusions are thus latched on a side of the spout ring 95 toward the bag, a position shown in FIG. 3. Because of the cooperative slopes on the finger protrusions and the ring 95, this action occurs smoothly. However, these slopes are maintained steep enough so that the spout and socket will not inadvertently become detached once placed in the stable, connected relationship shown in FIG. 3.

As can best be seen from FIG. 3, attachment of the socket 43 onto the spout 33 causes a valve 63 to be moved toward the bag 35. An end 97 of the valve member 63 then extends through the bag opening 41 a distance sufficient to keep the bag walls 37 and 39 from coming together when the bag is nearly empty of its liquid or other fluid. If the bag walls do come together, the opening 41 can undesirably be closed before all of the fluid is removed from the bag.

When in the connected position shown in FIG. 3, fluid flows from within the bag 35 up through an interior hollow portion of the valve member 63, and out of one or more openings 99 provided in an end of the valve 63 removed from the bag. The "x" shaped protrusion 76 of the socket valve member 73 has pushed the end 65 of the valve member 63 away from the valve seat surrounding the opening 61, thus allowing fluid to flow through the opening 61 of the spout 33, the opening 77 of the socket 43, and thus out of the dispenser through one or both of the openings 45 and 47. When in the connected position shown in FIG. 3, one end of the socket valve member 73 is pushed upward against a cap 101 that is threadedly attached to one end of the socket body member 69. At the same time, the skirt 65 of the spout valve member 63 is rolled in the manner shown in FIG. 3. Once the connector 43 is removed by pulling up the ring 81 and applying enough force to separate it from the spout 33, both the spout valve member 63 and the socket valve 73 return to their rest positions shown in FIG. 2.

The preferred material for the spout member 63 is a plastic sold under the trade name Santoprene by Monsanto. It has an advantageous characteristic of having a good elastic memory which makes it quite suitable for the resilient skirt 65. The entire valve member 63, including its skirt 65, is preferably molded as a single piece from this material. The other parts of the spout 33 and socket 43 can be made of any suitable plastic material through an injection-molding process.

In order to keep the spout valve member 63 properly positioned as it is moved back and forth in the body member 57, several slots are provided along the length of the member 63, such as the slot 103. A mating protrusion 105, provided as part of the shell 67 of the body member 57, extends into the slot 103. Similar protrusions are provided in other slots of the valve member 63 that are not shown. This combination of valve slot and spout body protrusion helps guide the valve member 63 as it is moved along its length, and also provides a maximum limit of travel of the valve member. This maximum travel is established when an end of the slot 103 abuts against the protrusion 105, as shown in FIG. 3.

The dispenser assembly of FIGS. 2 and 3 is provided with a keying system that allows the socket 43 to be latched onto the spout 33 only if the keying elements on each physically match each other. This allows, in effect, the containers to be coded as to their contents by providing a specific keying element as part of the spout 33. As a result, only those sockets 43 having a matching keying element can be connected for withdrawing liquid from the container.

A specific form of the keying system implemented in the embodiment of FIGS. 2 and 3 includes a circular ring 107 extending outward of an extreme end of the spout 33 by being molded as part of its end piece 59. A matching circular groove 109 is provided as part of the socket 43, being formed within its body piece 69. The groove 109 is formed at an extreme inner surface of the socket 43 that is normally contacted by an end of the spout 33. If the radii and shape of the ring 107 and groove 109 match each other, the ring 107 will fit into the slot 109 when the socket is connected onto the spout 33. The dimensions of these elements, as well as other elements of the connector, are chosen so that if the ring 107 and slot 109 do not match, the socket 43 will not be able to be attached to the spout 33. As can be seen from FIG. 3, such a mismatch will prevent the protrusions 89, 91, etc. on the respective resilient fingers 85 and 87 from moving over the ring 95. Thus, if a user attempts to connect the wrong fluid container to a socket, a permanent connection will not be made. This clearly then tells the user that the wrong container is being connected to the socket.

Containers having different fluids in them will have rings 107 on their spout 33 with different diameters, in a preferred form. Of course, other physical parameters could be varied, such as the thickness of the ring 107. Other alternatives are possible, such as varying the shape of the ring 107 to some non-circular shape specific to the liquid within the container. Matching sockets would then have corresponding grooves of a shape and size to receive these rings. Another alternative is that the ring or other shape can be discontinuous in a distinctive pattern to indicate a particular fluid in its container. Of course, the positions of the ring 107 and slot 109 can be reversed as between the spout 33 and socket 43.

Figure 6:
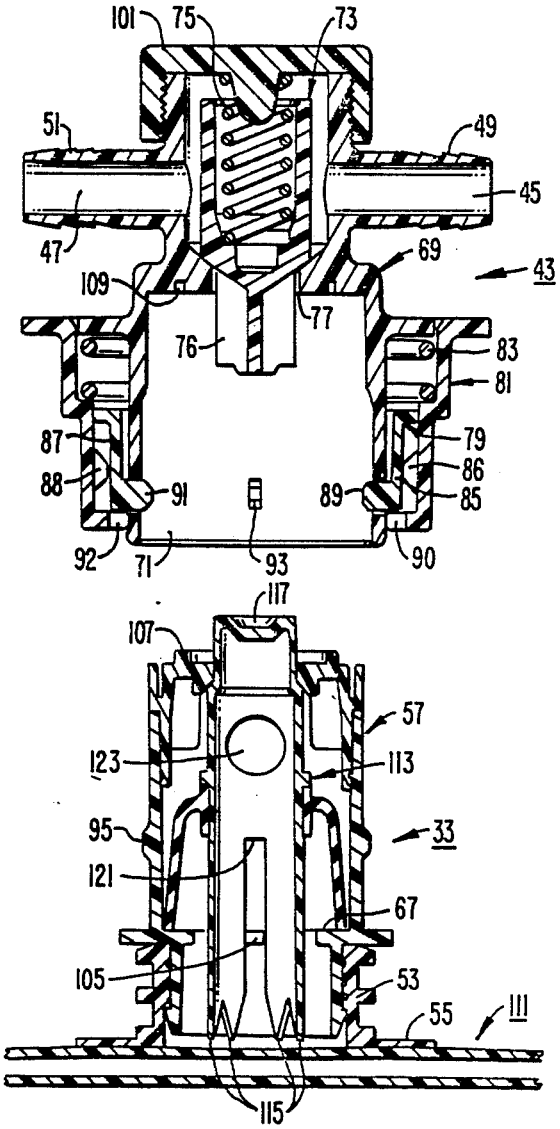
FIG. 6 shows in cross-section a second embodiment of a bag spout and socket before they are connected to each other.
Figure 7:
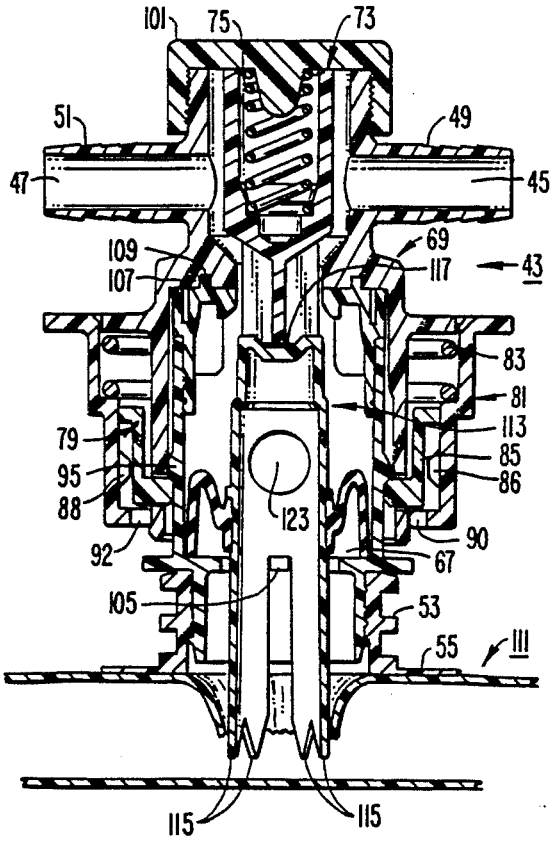
FIG. 7 is a cross-sectional view of the bag spout and socket of FIG. 6 after being connected together.

A second embodiment of the dispenser is illustrated in FIGS. 6 and 7. Since nearly all of the parts of the dispenser assembly of this embodiment are the same of those of the embodiment described with respect to FIGS. 2 and 3, the same reference numbers for the same parts are utilized. A spout 33 of FIG. 6 is attached to a bag 111 that has not been prepunched. The major distinction between the embodiment of FIGS. 6 and 7 and that of FIGS. 2 and 3 is that a means to punch a hole in the bag is provided for actuation automatically when the socket 43 is attached to the spout 33 for the first time.

Essentially, the only difference in the embodiment of FIGS. 6 and 7 and that of FIGS. 2 and 3 is the size and structure of a valve member 113, it being different than the valve member 63. One difference is the provision, as part of a valve end adjacent the bag 111, of sharp points 115 for piercing the bag upon its movement against the bag when the socket 43 is first attached to the spout 33. In order to effect such puncturing, however, the valve member 113 is made longer than the valve member 63 by extending another end 117 a distance out of the end aperture 61 of the spout end piece 59. A resilient skirt 119 of the valve 113 is also made to be larger than the skirt 65 in order to accommodate the additional distance of travel of the valve member 113. Similarly, the longitudinal grooves in the valve 113, such as the groove 121, are made to be longer than the counterparts of the valve 63 in order to accommodate the farther travel distance.

Otherwise, the valve element 113 operates similarly to its counterpart valve member 63 of the prior embodiment. In the unconnected position shown in FIG. 6, valve member 113 closes the opening 61. When the socket 43 is attached to the spout 33, shown in FIG. 7, a fluid path is provided through the inner portion of the valve member 113 and out of a plurality of apertures in it such as the aperture 123, through the matched openings of the spout 33 and socket 43.

Although the various aspects of the present invention have been described with respect preferred embodiments thereof, it should be understood that the invention is entitled to protection within the full scope of the appended claims.

We claim:

1. A dispenser for attachment to a bag for dispensing fluid therefrom, comprising:

a first assembly adapted for attachment to said bag, said first assembly including a first fluid valve resiliently closed, a second assembly adapted for fitting onto said first assembly, said second assembly including a second fluid valve resiliently closed, means including cooperative latching elements on said first and second assemblies for holding said first and second assemblies together in a manner that their said first and second valves are opened in order to form a fluid path from a bag, through the first assembly and out of said second assembly, wherein said holding means comprises:

a first of said latching elements including a ring carried by said second assembly and having a plurality of resilient fingers extending therefrom along an outside wall of said second assembly, each of said plurality of fingers terminating in a protrusion that extends through an aperture of said second assembly outside wall, a second of said latching elements including means provided as part of an outside wall surface of said first assembly for capturing said resilient finger protrusions when the first and second assemblies are urged together, thereby to hold said first and second assemblies together, and manually actuable means provided as part of said second assembly and normally preventing said finger protrusions from disengaging from said capturing means for allowing a disengagement thereof in a manner to permit removal of said second assembly from said first assembly, keying means provided as part of said first and second assemblies for preventing said latching mechanism from holding said first and second assemblies together except when cooperative elements on each of said first and second assemblies are cooperatively shaped, and means provided as part of said first valve and responsive to said first and second assemblies being latched together for extending into a bag to which the first assembly is attached, thereby to prevent a bag wall from closing off a fluid opening into the first assembly.

2. A dispenser for attachment to a bag for dispensing fluid therefrom, comprising:

a first assembly adapted for attachment to said bag, said first assembly including a first fluid valve resiliently closed, a second assembly adapted for fitting onto said first assembly, said second assembly including a second fluid valve resiliently closed, means including cooperative latching elements on said first and second assemblies for holding said first and second assemblies together in a manner that there said first and second valves are opened in order to form a fluid path from a bag, through the first assembly and out of said second assembly, wherein said holding means comprises:

a first of said latching elements including a ring carried by said second assembly and having a plurality of resilient fingers extending therefrom along an outside wall of said second assembly, each of said plurality of fingers terminating in a protrusion that extends through an aperture of said second assembly outside wall, a second of said latching elements including means provided as part of an outside wall surface of said first assembly for capturing said resilient finger protusions when the first and second assemblies are urged together, thereby to hold said first and second assemblies together, and manually actuable means provided as part of said second assembly and normally preventing said finger protrusions from disengaging from said capturing means for allowing a disengagement thereof in a manner to permit removal of said second assembly from said first assembly, and means responsive to said first and second assemblies being latched together for extending into a bag to which the first assembly is attached, thereby to prevent a bag wall from closing off a fluid opening into the first assembly.

3. The fluid dispenser according to claim 1 wherein said keying means includes an annular ring protruding from one of said first and second dispenser assemblies and a matching annular groove provided in another of said first and second assemblies for receiving the ring upon said first assembly being fitted onto said second assembly.

4. The dispenser according to claim 1 wherein said extending means includes a bag wall cutting element, thereby to allow a bag to which the first assembly is attached to remain sealed until pierced by said cutting element upon the second assembly being latched onto said first assembly.

5. The dispenser according to claim 2 wherein said extending means includes a bag wall cutting element, thereby to allow a bag to which the first assembly is attached to remain sealed until pierced by said cutting element upon the second assembly being latched onto said first assembly.

* * * * *